United States Patent [19]

Levefelt

[11] 4,184,554

[45] Jan. 22, 1980

[54] CHECK VALVE FOR ROCK DRILL

[75] Inventor: Bert G. Levefelt, Sandviken, Sweden

[73] Assignee: Sandvik Aktiebolag, Sandviken, Sweden

[21] Appl. No.: 909,118

[22] Filed: May 24, 1978

[30] Foreign Application Priority Data

May 24, 1977 [SE] Sweden ..... 7706028

[51] Int. Cl.[2] ..... E21B 39/00

[52] U.S. Cl. ..... 175/317; 175/318; 175/339; 166/325; 137/541; 137/549

[58] Field of Search ..... 175/317, 318, 337, 339; 166/325, 327; 137/541, 549

[56] References Cited

U.S. PATENT DOCUMENTS

| | | | |
|---|---|---|---|
| 1,687,120 | 10/1928 | Blanchard | 137/549 X |
| 1,692,265 | 11/1928 | Blom | 137/549 X |
| 2,619,316 | 11/1952 | Wilson | 137/541 |
| 3,401,758 | 9/1968 | Talbert | 175/337 X |
| 3,924,695 | 12/1975 | Kennedy | 175/339 X |

*Primary Examiner*—Ernest R. Purser
*Assistant Examiner*—Nick A. Nichols, Jr.
*Attorney, Agent, or Firm*—Burns, Doane, Swecker & Mathis

[57] ABSTRACT

A check valve for a rock drill comprises a valve plate carrying a cylindrical strainer. An insert is carried by the valve plate and is movable between valve-open and valve-closed positions. A spring biases the insert to a valve-closed position. The insert unit includes a lid which engages and covers the top of the strainer in a valve-open position, and a bottom plate which covers the valve plate in a valve-closed position to prevent cuttings from fouling the valve mechanism.

7 Claims, 4 Drawing Figures

CHECK VALVE FOR ROCK DRILL

BACKGROUND AND OBJECTS OF THE INVENTION

The present invention relates to a check valve, in particular for use in rock drill bits of the type that comprise a drill body, the upper part of which body having a bore and adapted to be connected to a drill tube, and the lower part of which body comprises a number of projecting legs, the lower ends of the legs carrying rotatable cutters provided with cutting inserts.

When drilling in rock with roller drill bits, compressed air is used for conveying crushed rock (cuttings) from the bottom of the drill hole to the top thereof. In order to bind the cuttings and lessen the formation of dust, the flushing air is often mixed with water. The flushing air is also used for cooling and cleaning the bearings of the rotating rollers that carry the cutting inserts. These bearings are unfavorably affected by water in the flushing air.

Furthermore, problems arise when drilling in rock ground containing water, where cuttings and water are liable to penetrate through the flushing jet orifices in the drill head to a valve that is used for preventing further upward penetration. This happens when the flushing air is shut off, usually when extending the drill tube. The valve is usually made in such a way that water is separated from the flushing air which is conducted to the bearings. In this way the life of the bearings can be extended. It is thus known to use valves in drill bits of the type mentioned in the introduction, but sufficient attention has not been paid to the problems with water separation and protection of vital parts against intrusion of cuttings.

One object of this invention is to provide a check valve having an improved ability to separate water and to substantially reduce the risk for intrusion of cuttings and their effect on the function of the valve.

It is another object of the invention to provide a spring-biased valve which is less susceptible to fatigue stresses.

BRIEF SUMMARY OF A PREFERRED EMBODIMENT OF THE INVENTION

These objects are achieved by a valve which includes a valve plate in sheet form and a cylindrical strainer body connected therewith. The valve plate is adapted to sealingly abut against an annular shoulder in the bore of the drill body.

An insert is centrally and slidably movable in relation to the valve plate and the strainer body and carries a sheet shaped lid. When flushing medium is supplied, the lid is subjected to the action thereof to open the valve against the bias of a spring. The lid moves into tight abutment with that end of the strainer which faces away from the valve plate to cover such end of the strainer.

Due to this arrangement, the movable part of the valve rests in its open position against the cylindrical strainer body. The spring, which is disposed between the lid and the valve plate, is thus not subjected to varying forces and thus not to fatigue stresses and is at the same time well protected from cuttings that intrude from below. Other features specific to the invention are defined in more detail in the following.

THE DRAWING

A preferred embodiment of the invention is described in more detail below in connection with the appended drawings in which:

FIG. 1 is an axial section of a preferred embodiment of the invention taken along line I—I in FIG. 2, FIG. 2 is a top end view of the valve of FIG. 1, FIG. 3 is an axial section through a roller drill bit with a valve attached thereto, and FIG. 4 is an enlarged view of the upper part of the drill bit in FIG. 3 where the valve is shown in closed position.

DETAILED DESCRIPTION OF A PREFERRED EMBODIMENT OF THE INVENTION

Figure 1:
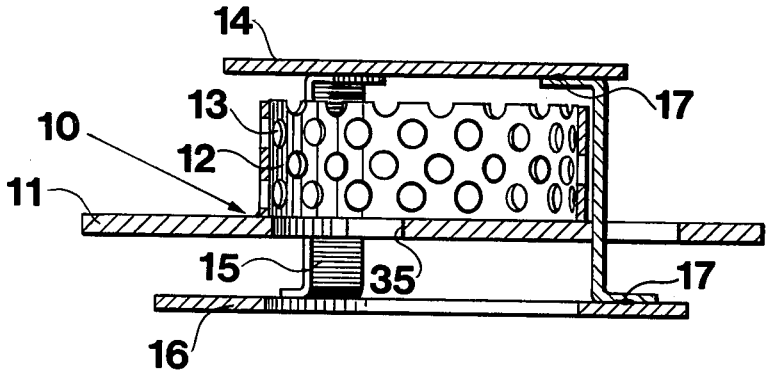
Figure 2:
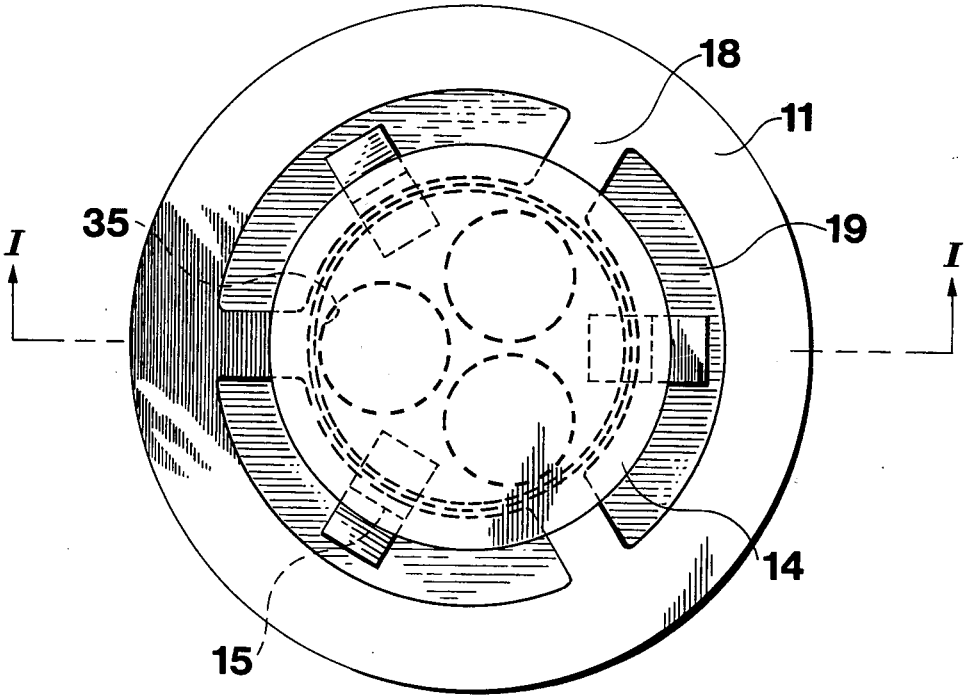

The embodiment of the check valve 10 shown in FIGS. 1 and 2 can be said to comprise two cooperating valve components. One valve component comprises a valve plate 11 and a strainer body 12. The valve plate is formed as a sheet, and the strainer body is centrally and coaxially attached thereto, the mantle surface of which strainer body is provided with round holes 13 to let the flushing medium through. The other valve component is intended to form an insertion that is movable in relation to the first valve component. The other component comprises a circular lid 14 supported by three axially formed legs 15, for instance formed of flat bar iron which surround the strainer body 12 and which are attached to both the lid 14 and to a bottom ring 16 by weld joints 17. The lid 14 is of greater diameter than the outer mouth of the strainer body 12 which faces away from the valve plate 11, i.e., the end of the strainer body located remotely relative to the valve plate.

In order to make it possible for the insertion to move in relation to the valve plate 11 and the strainer body 12 attached thereto, the valve plate 11 is provided with three radial arms 18 forming between them three openings 19. The axial legs 15 of the insertion are dimensioned such that they easily can pass through the openings 19. At the same time the bottom ring 16, which is attached to the legs 15, is dimensioned such that it completely covers the openings 19 when it is brought into contact with the valve plate 11.

Figure 3:
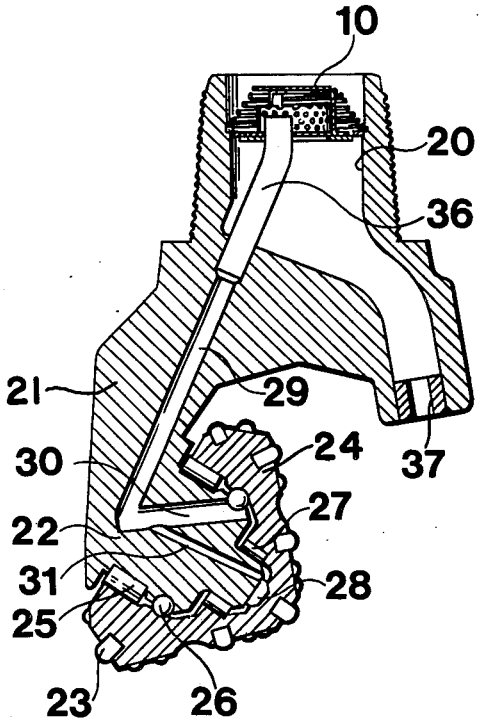

FIG. 3 shows the valve mounted on the upper part of a roller drill bit having a bore or chamber 20 and adapted to be connected to a drill tube. In a quite conventional way the drill bit comprises three legs 21, on which bearing lugs 22 are formed. On each bearing lug is a roller 24 with inserts 23 journalled by means of a system of roller bearings 25, ball bearings 26, friction bearings 27 and axial bearings 28. For cooling and flushing of the bearings compressed air is circulated to a channel 29 in the leg from where the air is conducted further to the bearing system via branch channels 30, 31.

The valve plate 11 is fixed by means of a locking ring 33 against a shoulder 32 extending around the bore 20.

A coil compression spring 34 of conical shape is positioned between the lid 14 and the locking ring 33 (or the plate 11) to urge the lid 14 to a valve closing position away from the strainer body 13. The inner mouth of the strainer body is formed by a plate having three openings 35 for receiving tubes 36. These tubes communicate with the cooling channels 29, 30, 31 of each leg for conducting flushing air thereto.

Figure 4:
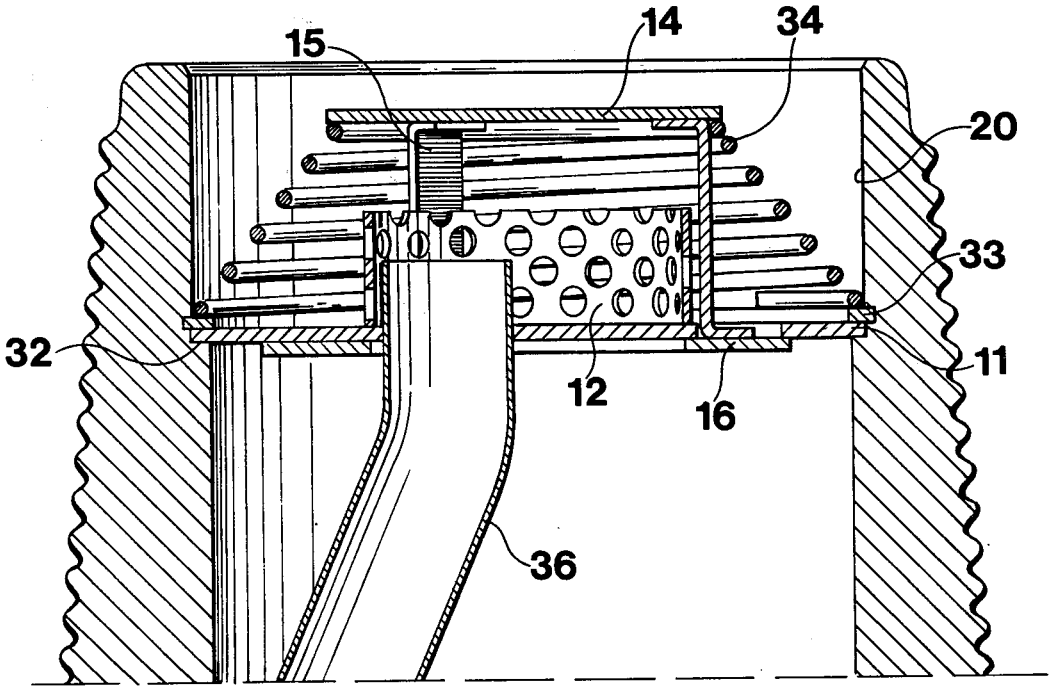

FIG. 4 shows the valve in closed position or mode. When the flushing air to the bit is delivered the valve opens. Under the action of the flushing air the lid 14 is biased against the action of the spring 34 into abutment with the upper mouth of the strainer body 12. The upper mouth of the strainer being thus protected and covered by the lid 14, the flushing air is required to traverse the strainer body 12 through the holes 13. The air must also, because of this, change its direction so that accompanying heavier particles such as water, continue straight on and pass out through the flushing nozzles, one of which is shown and marked 37 in FIG. 3, and which are designed for cleaning the bottom of the hole from cuttings. The result is a less amount of water in the air delivered to the bearings. Since the lid 14 engages the strainer body 13, the spring 34 will be subjected to a constant compression force throughout the flushing period. That is, the normal slight fluctuations in pressure of the flushing medium will not be enough to enable the lid to be raised, so the stresses on the spring will not vary. Therefore, the spring is subjected to less fatigue and exhibits a longer life-span.

When the supply of flushing air ceases, the insertion is returned axially by the helical spring so that the valve returns to the closed position illustrated in FIG. 4. In this valve position also the spring 34 is well protected from cuttings intruding from below (through the nozzles 37 for example) and is influenced only by water, which may leak through.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A check valve for use in rock drill bits of the type comprising a drill body having a chamber at its upper end for connection to a drill tube and having a plurality of projecting legs carrying rotatable cutters having cutting inserts, and passage means for conducting flushing medium to said cutter, said check valve comprising:

a valve plate extending across said chamber, a cylindrical strainer body mounted atop said valve plate, said strainer body including perforations for conducting flushing medium, an insertion mounted for movement relative to said valve plate and strainer body and comprising:

a lid which is positioned to be acted upon by the action of the flushing medium and urged into contact with an end of said strainer body disposed remotely of said valve plate, and a valve closing plate operably connected to said lid and disposed below said valve plate for opening the valve when said lid is urged against said strainer body, and valve closing means for normally urging said lid away from said strainer body and urging said valve closing plate to a position closing said valve and being yieldable in response to the action of the flushing medium against said lid to permit movement of said lid to open said valve plate and contact said strainer body.

2. A check valve as defined in claim 1, wherein said strainer body is arranged coaxially relative to said valve plate, said valve plate being supported by an annular shoulder located in said chamber of said drill body, the end of said strainer body located remotely relative to said valve plate comprising an open mouth which is tightly closed-off by said lid in the open position of said valve, causing air in the flushing medium to travel through said strainer body.

3. A check valve as defined in claim 1, wherein a lower end of said strainer comprises a plate having a plurality of apertures, a plurality of tubes received in respective ones of said apertures such that upper ends of said tubes communicate with said strainer body and lower ends of said tubes communicate with said passage means for conducting flushing medium to said cutters.

4. A check valve according to claim 1, wherein said valve plate comprises a plurality of openings, said insertion further comprising a bottom ring located below said valve plate and a plurality of legs extending through said openings and interconnecting said lid and said bottom ring.

5. A check valve according to claim 4, wherein said bottom ring is arranged to close-off said openings in said valve plate when said insert is in the valve closed position and to uncover said openings in the open position of said valve.

6. A check valve according to claim 4, wherein said openings are defined by spaced radial arms of said valve plate.

7. A check valve according to claim 5, wherein said valve closing means comprises a conical coil spring acting between said lid and said valve plate, said spring yieldably urging said lid away from said strainer body to the valve-closed position wherein said bottom ring abuts against said valve plate and covers said openings.

* * * * *